US006431930B1

(12) United States Patent
Holt

(10) Patent No.: US 6,431,930 B1
(45) Date of Patent: Aug. 13, 2002

(54) ELECTRONIC CONTROL SYSTEM FOR BOATS

(75) Inventor: James L. Holt, Burlington, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/162,566

(22) Filed: Sep. 29, 1998

(51) Int. Cl.[7] ..... B60K 41/00
(52) U.S. Cl. ..... 440/84; 440/88
(58) Field of Search ..... 440/84, 86, 87, 440/1

(56) References Cited

U.S. PATENT DOCUMENTS

| | | | | | |
|---|---|---|---|---|---|
| 4,419,729 | A | * | 12/1983 | Krieder | 701/93 |
| 4,739,236 | A | * | 4/1988 | Burkenpas | 114/144 |
| 4,810,216 | A | * | 3/1989 | Kawamura | 440/84 |
| 4,836,809 | A | * | 6/1989 | Pelligrino | 440/2 |
| 4,976,636 | A | * | 12/1990 | Torigai et al. | 440/1 |
| 5,074,810 | A | * | 12/1991 | Hobbs et al. | 440/2 |
| 5,142,473 | A | * | 8/1992 | Davis | 364/424.01 |
| 5,214,977 | A | | 6/1993 | Nagafusa | 74/480 |
| 5,222,414 | A | | 6/1993 | Kobayashi | 74/527 |
| 5,222,901 | A | | 6/1993 | Burkenpas | 74/480 |
| 5,539,294 | A | | 7/1996 | Kobayashi | 318/675 |
| 5,645,032 | A | * | 7/1997 | Motose | 123/339.16 |
| 5,700,171 | A | * | 12/1997 | Horton | 440/87 |
| 5,775,451 | A | * | 7/1998 | Hull et al. | 180/170 |
| 6,086,435 | A | * | 7/2000 | Hoshiba et al. | 440/1 |

FOREIGN PATENT DOCUMENTS

| | | | | | |
|---|---|---|---|---|---|
| JP | 03000589 | A | * | 1/1991 | 440/86 |

* cited by examiner

*Primary Examiner*—S. Joseph Morano
*Assistant Examiner*—Andy Wright
(74) *Attorney, Agent, or Firm*—Timothy J. Ziolkowski

(57) ABSTRACT

A boat having a propulsion system and a station containing throttle, shift and cruise controls at some distance from the propulsion system. The throttle, shift and cruise control elements generate electrical signals which are transmitted to a electronic control unit in the propulsion system. The electronic control unit controls the fuel injection and the ignition of fuel for the propulsion system and also signals the throttle and the transmission in response to an operator's manipulation of the throttle, shift or cruise control elements. There are no mechanical links or cables between the throttle, shift and cruise control elements and the propulsion system.

22 Claims, 2 Drawing Sheets

ELECTRONIC CONTROL SYSTEM FOR BOATS

BACKGROUND OF THE INVENTION

1. Field of the Invention

The present invention relates to a boat having an electronic control system and more particularly to a boat having electronic throttle, shift and cruise controls without mechanical cables or the like between an operator control station and the propulsion system for the boat.

2. Description of the Related Art

Most typically, throttle and shift control on a boat are accomplished by cables or other mechanical linkages extending between an operator station located about midway along the length of a boat and the propulsion system at or near the stern of the boat. More recently, there has been efforts to use electronics for such controls where there is a second or remote operator control station. For examples, see U.S. Pat. Nos. 5,214,977; 5,222,414; 5,222,901; and 5,539,294. It is noted that the various systems described in the above-mentioned patents still rely upon cables or other mechanical linkages for some portion of the distance between the operator control station or stations and the propulsion system of the boat.

BRIEF DESCRIPTION OF THE INVENTION

The shortcomings of the previous systems have been overcome by the present invention. What is described here is a boat with a propulsion system, the system including an engine, a transmission and a thrust producer, wherein the motor is connected to the boat, the engine is disposed in a housing or the boat itself and the engine has a throttle, the boat comprising in combination: a transmission control element mounted to the boat at a distance from the engine for use by an operator, a throttle control element mounted to the boat at a distance from the engine for use by an operator, a cruise control element mounted to the boat at a distance from the engine for use by an operator, an electronic control unit connected to the propulsion system, a first element connected to the engine throttle for transforming electrical energy into mechanical energy, a second element connected to the transmission for transforming electrical energy into mechanical energy, a first electrically conductive element connecting the transmission control element to the electronic control unit, a second electrically conductive element connecting the throttle control element to the electronic control unit, a third electrically conductive element connecting the cruise control element to the electronic control unit, a fourth electrically conductive element connecting the electronic control unit to the first element for transforming electrical energy into mechanical energy and a fifth electrically conductive element connecting the electronic control unit to the second element for transforming electrical energy into mechanical energy wherein movement of one or more of the transmission control element, the throttle control element and the cruise control element causes the electronic control unit to relay signals that adjust the engine and/or the transmission accordingly without the use of mechanical cables or links between the mounted control elements and the engine.

An object of the present invention is to provide a boat with an electronic control system between an operator's station and the boat's propulsion system that does not incorporate mechanical cables or other mechanical linkages. Another aim of the present invention is to provide a boat with an electronic control system where the system is simple, reliable and inexpensive. Yet another aim of the present invention is to provide an electronic control system that incorporates electronic processing capability already incorporated with the propulsion system. Still another advantage of the present invention is to provide an electronic control system that is aesthetically pleasing.

A more complete understanding of the present invention and other objects, aspects, aims and advantages thereof will be gained from a consideration of the following description of the preferred embodiments in conjunction with the accompanying drawings provided herein.

DESCRIPTION OF THE PREFERRED EMBODIMENTS

Figure 1:
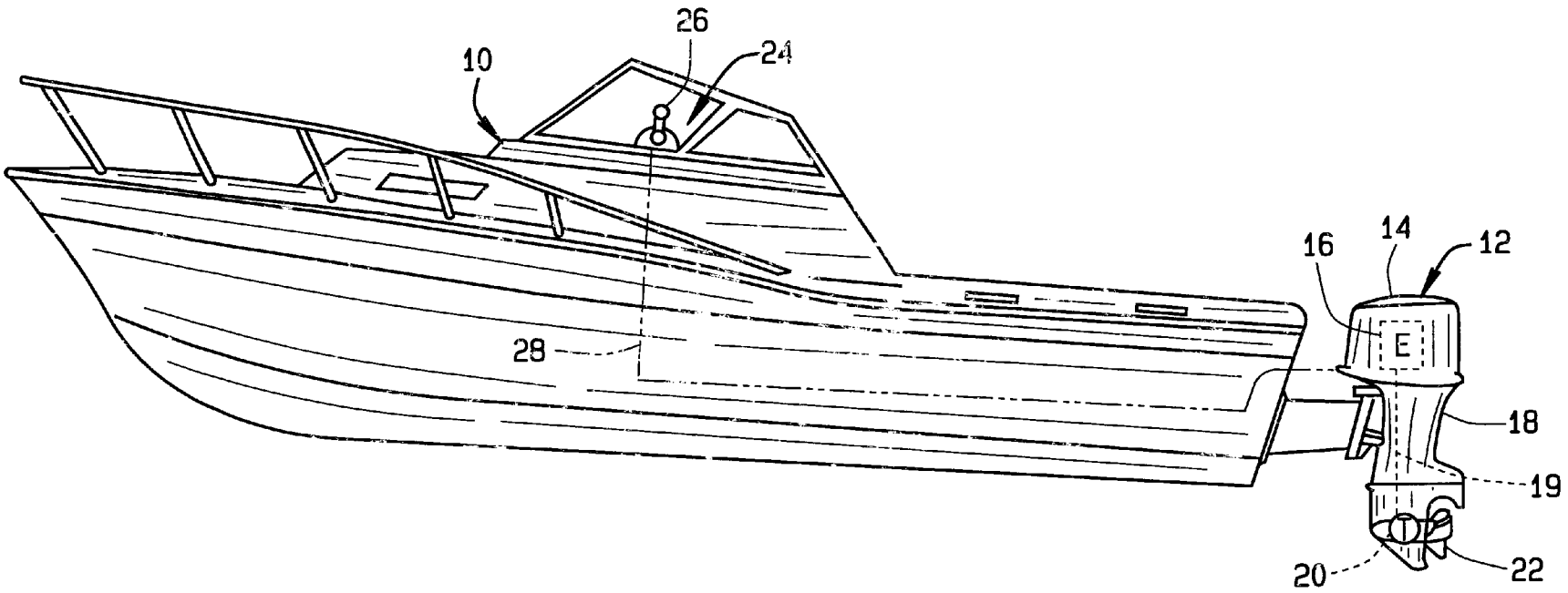
FIG. 1 is a diagrammatic elevational view of a boat and a propulsion system.

While the present invention is opened to various modifications and alternative constructions, the preferred embodiments shown in the drawings will be described herein in detail. It is understood, however, that there is no intention to limit the invention to the particular forms disclosed. On the contrary, the intention is to cover all modifications, equivalent structures and methods and alternative constructions falling within the spirit and scope of the invention as expressed in the appended claims.

Referring now to FIG. 1, there is illustrated in diagrammatic form, a boat 10 and a propulsion system 12 in the form of an outboard motor. The outboard motor includes a housing 14, an engine within the housing 16, a drive shaft enclosure 18, a drive shaft 19, a transmission 20 and a thrust-producer, such as a propeller 22. The design, manufacture and assembly of a boat and of an outboard motor are known to those skilled in the respective arts.

An operator station 24 is illustrated about midway between the bow and the stern of the boat. A throttle/shift control lever 26 is located at the operator station. As can be easily seen, the throttle/shift control lever is some distance from the propulsion system 12. Illustrated in phantom line 28, is the electrical connection between the throttle/shift control lever 26 at the operator station and the propulsion system 12. What is conspicuously absent are mechanical cables or other mechanical linkages between the throttle/shift control lever and the propulsion system.

The use of electrical wire or wires is more economical than cable, is relatively simple and is reliable. Electrical wire is also easier to route through a boat. Furthermore, the absence of mechanical cables or the like makes for a substantially more aesthetically pleasing arrangement than is now the case.

Figure 2:
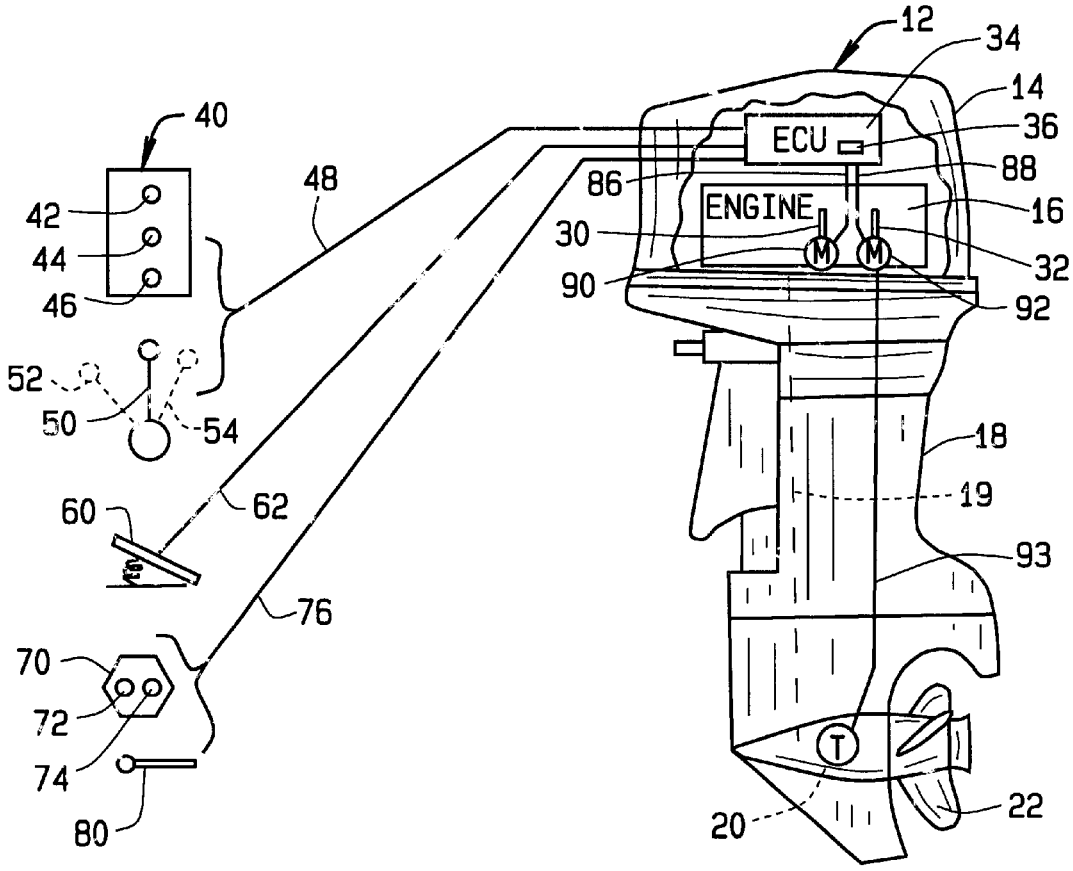
FIG. 2 is a diagrammatic illustration, partially cut-away, of the various control elements and the propulsion system.

Referring now to FIG. 2, the propulsion system 12 is illustrated in more detail. As mentioned, the propulsion system includes a housing 14, also called a cowling, within which the engine 16 is mounted. Connected to the engine is a throttle represented by a lever 30 and a shift mechanism represented by a shift lever 32. Also, within the housing is an electronic control unit 34, often referred to as an ECU. Such units typically include a microprocessor 36 and are used to control fuel injection and ignition for the engine. For example, the OMC Company of Waukegan, Ill. markets JOHNSON and EVINRUDE brand outboard engines having FICHT brand fuel injection technology. As part of this technology an electric control unit monitors and controls fuel injection and ignition among other things. With a proper capacity, an ECU microprocessor may also be used to receive signals from a distant location or locations and to process and transmit responsive signals to the throttle 30 and the shift 32.

Instead of the throttle/shift control lever 26 there is shown in FIG. 2, a pushbutton array 40 having a forward button 42, a neutral button 44 and a reverse button 46. Each of these buttons actuates a switch (not shown) that sends a signal by way of a first electrically conductive element, such as an electric wire 48. An alternative arrangement is shown in lever format 50. For example, a lever may be movable between a forward position shown in phantom lines 52 and a reverse position 54 also shown in phantom line. A potentiometer (not shown) may be used to create a signal which is then transmitted through the electric wire 48.

As an example of a throttle control element, there is illustrated a spring biased foot pedal 60 which may also be attached to a potentiometer (not shown) that will create and send a signal through a second electrically conductive element such as a second electrical wire 62. A cruise control element in the form of a pushbutton mechanism 70 having a first button 72 for activating the cruise control and a second button 74 for acceleration. An alternative throttle control element is shown as a lever 80 which may be used to actuate the cruise control by a downward flip and increase acceleration by an upward flip. Both the element 70 and lever 80 are attached to switches (not shown). The signals from the cruise control element 70 and lever 80 are transmitted by a third electrically conductive element, such as an electrical wire 76.

Signals from each of the control elements 40, 50, 60, 70 and/or 80 are received by the ECU 34 and processed by the microprocessor 36. After processing, signals are sent via fourth or fifth electrically conductive elements, such as an electrical wire 86 and/or an electrical wire 88 to adjust the throttle or to shift the transmission. With regard to the throttle, a first element for transforming electrical energy into mechanical energy, such as a first servo motor 90, may be used to adjust the throttle setting. Throttle signals may be created by either the foot pedal 60, (or the lever 26) or the cruise control mechanisms 70, 80. Connected to the transmission lever 32 is a second element for transforming electrical energy into mechanical energy, such as a second servo motor 92. The shift lever 32 is connected to the transmission in any suitable manner as indicated by the line 93 and which is known by those skilled in the art.

In operation, an operator, at the operation station 24, manipulates the push buttons 40 or a lever 50, to signal the transmission to "forward", "reverse" or "neutral." The operator may then signal the engine through the foot pedal 60 or by a lever to revolve at a predetermined revolutions per minute (rpm). The cruise control may also be engaged to operate the throttle to maintain a certain rpm or to accelerate. Another mechanism may be used to deactivate the cruise control. It is now apparent that a boat incorporating the present invention is easier to operate and more ergonomically comfortable.

The specification describes in detail several embodiments of the present invention. Other modifications and variations will, under the doctrine of equivalents come within the scope of the appended claims. For example, other types of control elements operations interface may be used and perhaps signals from the control elements to the ECU may be sent without electrical wires. For example, infrared or radio transmission may be used. Also, though the specification is concerned with an outboard motor, an inboard motor also be used. Still other alternatives will also be equivalent as will many new technologies. There is no desire or intention here to limit in any way the application of the doctrine of equivalents.

What is claimed is:

1. A boat with a propulsion system, said system including an outboard engine, a transmission and a thrust producer wherein said engine is connected to said boat, said engine is disposed in a cowling and said engine has a throttle, said boat comprising in combination:

a transmission control element mounted to said boat at a distance from said engine for use by an operator;

a throttle control element mounted to said boat at a distance from said engine for use by an operator;

a cruise control element mounted to said boat at a distance from said engine for use by an operator;

an electronic control unit mounted in said cowling and electrically coupled to said transmission control element, said throttle control element, and said cruise control element;

a first element for transforming electrical energy into mechanical energy connected to the engine throttle;

a second element for transforming electrical energy into mechanical energy connected to the transmission;

a first electrically conductive element connecting said electronic control unit to said first element for transforming electrical energy into mechanical energy; and a second electrically conductive element connecting said electronic control unit to said second element for transforming electrical energy into mechanical energy, wherein movement of one or more of said transmission control element, said throttle control element, and said cruise control element causes said electronic control unit to relay signals that adjust the engine or the transmission accordingly without use of mechanical cables or links between the control elements and the propulsion system; and said throttle control element comprises a foot pedal.

2. An apparatus as claimed in claim 1 wherein:

said transmission control element comprises a lever.

3. An apparatus as claimed in claim 1 wherein:

said transmission control element comprises push buttons.

4. An apparatus as claimed in claim 1 wherein:

said first element for transforming electrical energy into mechanical energy comprises a first servo motor; and said second element for transforming electrical energy into mechanical energy comprises a second servo motor.

5. An apparatus as claimed in claim 1 further comprising an electrically conductive element connecting said cruise control element to said electronic control unit.

6. An apparatus as claimed in claim 1 wherein:

said electronic control unit controls fuel injection and ignition for said engine.

7. A boat with a propulsion system, said system including an outboard engine, a transmission and a thrust producer wherein said engine is connected to said boat, said engine is disposed in a cowling and said engine has a throttle, said boat comprising in combination:

a transmission control element mounted to said boat at a distance from said engine for use by an operator;

a throttle control element mounted to said boat at a distance from said engine for use by an operator;

a cruise control element mounted to said boat at a distance from said engine for use by an operator;

an electronic control unit mounted in said cowling and electrically coupled to said transmission control element, said throttle control element, and said cruise control element;

a first element for transforming electrical energy into mechanical energy connected to the engine throttle;

a second element for transforming electrical energy into mechanical energy connected to the transmission;

a first electrically conductive element connecting said electronic control unit to said first element for transforming electrical energy into mechanical energy; and a second electrically conductive element connecting said electronic control unit to said second element for transforming electrical energy into mechanical energy, wherein movement of one or more of said transmission control element, said throttle control element, and said cruise control element causes said electronic control unit to relay signals that adjust the engine or the transmission accordingly without use of mechanical cables or links between the control elements and the propulsion system; and said transmission control element comprises an array of push buttons.

8. An apparatus as claimed in claim 7 wherein said throttle control element comprises a foot petal.

9. An apparatus as claimed in claim 7 wherein said cruise control element comprises push buttons.

10. An apparatus as claimed in claim 7 wherein said first element for transforming electrical energy into mechanical energy comprises a first servo motor; and said second element for transforming electrical energy into mechanical energy comprises a second servo motor.

11. An apparatus as claimed in claim 7 further comprising an electrically conductive element connecting said cruise control element to said electronic control unit.

12. An apparatus as claimed in claim 7 wherein said electronic control unit controls fuel injection and ignition for said engine.

13. A boat with a propulsion system, said system including an outboard engine, a transmission and a thrust producer wherein said engine is connected to said boat, said engine is disposed in a cowling and said engine has a throttle, said boat comprising in combination:

a transmission control element mounted to said boat at a distance from said engine for use by an operator;

a throttle control element mounted to said boat at a distance from said engine for use by an operator;

a cruise control element mounted to said boat at a distance from said engine for use by an operator;

an electronic control unit mounted in said cowling and electrically coupled to said transmission control element, said throttle control element, and said cruise control element;

a first element for transforming electrical energy into mechanical energy connected to the engine throttle;

a second element for transforming electrical energy into mechanical energy connected to the transmission;

a first electrically conductive element connecting said electronic control unit to said first element for transforming electrical energy into mechanical energy; and a second electrically conductive element connecting said electronic control unit to said second element for transforming electrical energy into mechanical energy, wherein movement of one or more of said transmission control element, said throttle control element, and said cruise control element causes said electronic control unit to relay signals that adjust the engine or the transmission accordingly without use of mechanical cables or links between the control elements and the propulsion system;

said throttle control element comprises a foot pedal;

at least one of said transmission control element and said cruise control element comprises push buttons; and at least one of said first element for transforming electrical energy into mechanical energy and said second element for transforming electrical energy into mechanical energy comprises a servo motor.

14. An apparatus as claimed in claim 13 wherein said transmission control element comprises an array of push buttons.

15. An apparatus as claimed in claim 13 wherein said transmission control element comprises a lever.

16. An apparatus as claimed in claim 13 wherein said first element for transforming electrical energy into mechanical energy comprises a first servo motor; and said second element for transforming electrical energy into mechanical energy comprises a second servo motor.

17. An apparatus as claimed in claim 13 further comprising an electrically conductive element connecting said cruise control element to said electronic control unit.

18. An apparatus as claimed in claim 13 wherein said electronic control unit controls fuel injection and ignition for said engine.

19. A boat with a propulsion system, said system including an outboard engine, a transmission, and a thrust producing element, and said boat having an operator station at a distance from said propulsion system comprising:

a transmission control element mounted to said boat at said operator station for use by an operator of said boat;

a throttle control element mounted to said boat at said operator station for use by an operator of said boat, said throttle control element comprising a foot pedal;

a cruise control element mounted to said boat at said operator station for use by an operator of said boat;

an electronic control unit connected to said propulsion system for controlling fuel injection and ignition;

first means connected to said engine for operating the throttle of said engine in response to a signal from said electronic control unit;

second means connected to said propulsion system for operating the shift of said transmission in response to a signal from said electronic control unit;

third means connected to said boat for transmitting signals from said throttle control element to said electronic control unit;

fourth means connected to said boat for transmitting signals from said transmission control element to said electronic control unit;

fifth means connected to said boat for transmitting signals from said cruise control element to said electronic control unit;

sixth means connected to said propulsion system for transmitting signals from said electronic control unit to said first means; and seventh means connected to said propulsion system for transmitting signals from said electronic control unit to said second means, wherein movement of one or more of said transmission control element, said throttle control element, and said cruise control element causes said electronic control unit to relay signals that adjust the engine of the transmission accordingly, without the use of mechanical cables or links between the control elements and the propulsion system.

20. A boat with a propulsion system, said system including an outboard engine, a transmission, and a thrust producing element, said boat having an operator station spaced from said propulsion system comprising:

a transmission control element mounted to said boat at said operator station for use by an operator of said boat, said transmission element comprising an array of push buttons;

a throttle control element mounted to said boat at said operator station for use by an operator of said boat;

a cruise control element mounted to said boat at said operator station for use by an operator of said boat;

an electronic control unit connected to said propulsion system for controlling said propulsion system;

means connected to said engine for operating the throttle of said engine in response to a signal from said electronic control unit;

means connected to said propulsion system for operating the shift of said transmission in response to a signal from said electronic control unit;

means connected to said boat for transmitting signals from said throttle control element, from said transmission control element, and from said cruise control element to said electronic control unit;

means connected to said propulsion system for transmitting signals from said electronic control unit to said throttle operating means and to said shift operating means, wherein movement of one or more of said transmission control element, said throttle control element and said cruise control element causes said electronic control unit to issue signals for adjusting the engine or the transmission accordingly, without the use of mechanical cables or links between the control elements and the propulsion system.

21. A boat with a propulsion system, said system including an outboard engine, a transmission, and a thrust producing element, and said boat having an operator station at a distance from said propulsion system comprising:

a transmission control element mounted to said boat at said operator station for use by an operator of said boat, said transmission control element comprising an array of push buttons;

a throttle control element mounted to said boat at said operator station for use by an operator of said boat;

a cruise control element mounted to said boat at said operator station for use by an operator of said boat;

an electronic control unit connected to said propulsion system for controlling fuel injection and ignition;

first means connected to said engine for operating the throttle of said engine in response to a signal from said electronic control unit;

second means connected to said propulsion system for operating the shift of said transmission in response to a signal from said electronic control unit;

third means connected to said boat for transmitting signals from said throttle control element to said electronic control unit;

fourth means connected to said boat for transmitting signals from said transmission control element to said electronic control unit;

fifth means connected to said boat for transmitting signals from said cruise control element to said electronic control unit;

sixth means connected to said propulsion system for transmitting signals from said electronic control unit to said first means; and seventh means connected to said propulsion system for transmitting signals from said electronic control unit to said second means, wherein movement of one or more of said transmission control element, said throttle control element, and said cruise control element causes said electronic control unit to relay signals that adjust the engine of the transmission accordingly, without the use of mechanical cables or links between the control elements and the propulsion system.

22. A boat with a propulsion system, said system including an outboard engine, a transmission, and a thrust producing element, said boat having an operator station spaced from said propulsion system comprising:

a transmission control element mounted to said boat at said operator station for use by an operator of said boat;

a throttle control element mounted to said boat at said operator station for use by an operator of said boat, said throttle control element comprising a foot pedal;

a cruise control element mounted to said boat at said operator station for use by an operator of said boat;

an electronic control unit connected to said propulsion system for controlling said propulsion system;

means connected to said engine for operating the throttle of said engine in response to a signal from said electronic control unit;

means connected to said propulsion system for operating the shift of said transmission in response to a signal from said electronic control unit;

means connected to said boat for transmitting signals from said throttle control element, from said transmission control element, and from said cruise control element to said electronic control unit; and means connected to said propulsion system for transmitting signals from said electronic control unit to said throttle operating means and to said shift operating means, wherein movement of one or more of said transmission control element, said throttle control element and said cruise control element causes said electronic control unit to issue signals for adjusting the engine or the transmission accordingly, without the use of mechanical cables or links between the control elements and the propulsion system.

* * * * *

UNITED STATES PATENT AND TRADEMARK OFFICE

CERTIFICATE OF CORRECTION

PATENT NO. : 6,431,930 B1
DATED : August 13, 2002
INVENTOR(S) : James L. Holt

It is certified that error appears in the above-identified patent and that said Letters Patent is hereby corrected as shown below:

Column 3,
Line 7, insert -- lever -- after "the shift";

Signed and Sealed this

Fifteenth Day of October, 2002

*Attest:*

*Attesting Officer*

JAMES E. ROGAN
*Director of the United States Patent and Trademark Office*